US009998844B2

(12) United States Patent
Aoki

(10) Patent No.: US 9,998,844 B2
(45) Date of Patent: Jun. 12, 2018

(54) SIGNAL PROCESSING DEVICE AND SIGNAL PROCESSING METHOD

(71) Applicant: Yamaha Corporation, Hamamatsu-shi, Shizuoka (JP)

(72) Inventor: Ryotaro Aoki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days. days.

(21) Appl. No.: 15/458,377

(22) Filed: Mar. 14, 2017

(65) Prior Publication Data

US 2017/0272884 A1 Sep. 21, 2017

(30) Foreign Application Priority Data

Mar. 15, 2016 (JP) ..... 2016-051220

(51) Int. Cl.
*H04R 5/00* (2006.01)
*H04S 5/00* (2006.01)

(52) U.S. Cl.
CPC ..... *H04S 5/005* (2013.01); *H04S 2400/01* (2013.01); *H04S 2400/05* (2013.01); *H04S 2420/07* (2013.01)

(58) Field of Classification Search
CPC ..... H04S 2400/05; H04S 5/005; H04S 5/02; H04S 3/00; H04S 2400/01; H04S 2420/07
USPC ..... 381/27, 18, 19, 307, 80, 17
See application file for complete search history.

(56) References Cited

U.S. PATENT DOCUMENTS 5,426,702 A * 6/1995 Aarts ..... H04S 5/00 381/22
7,003,467 B1 2/2006 Smith et al.
2005/0078831 A1 4/2005 Irwan et al.
2009/0252339 A1* 10/2009 Obata ..... H04S 5/02 381/18

OTHER PUBLICATIONS

Extended European Search Report issued in counterpart European Application No. 17161060.3 dated Jul. 14, 2017 (Ten (10) pages).

* cited by examiner

*Primary Examiner* — Norman Yu
(74) *Attorney, Agent, or Firm* — Crowell & Morring LLP

(57) ABSTRACT

A signal processing device includes: a calculating unit performing calculation using signal levels of first and second acoustic signals; a determining unit, based on a result of a comparison between: the signal level of at least one of the first and second acoustic signals before the calculation; and a result of the calculation, determining whether a component of a third acoustic signal to be output from a position between a position from which the first acoustic signal is output and a position from which the second acoustic signal is output is included in the first and second acoustic signals; and a signal generating unit generating the third acoustic signal from the first and second acoustic signals when the determining unit determines that the component of the third acoustic signal is included in the first and second acoustic signals.

19 Claims, 11 Drawing Sheets

FIG. 4

| NO | AMPLITUDE OF Lin | AMPLITUDE OF Rin | Lin+Rin | Lin−Rin | 1ST CONDITION Lin+Rin > Lin | 2ND CONDITION Lin+Rin > Rin | 3RD CONDITION Lin−Rin < Lin | 4TH CONDITION Lin−Rin < Rin |
|---|---|---|---|---|---|---|---|---|
| 1 | 0.5 | 0.5 | 1 | 0 | ○ | ○ | ○ | ○ |
| 2 | 0.35 | 0.65 | 1 | 0.3 | ○ | ○ | ○ | ○ |
| 3 | 0.25 | 0.75 | 1 | 0.5 | ○ | ○ | × | ○ |
| 4 | 0 | 1 | 1 | 1 | ○ | × | × | × |

FIG. 6

| ELAPSED TIME | BAND HAVING MAXIMUM VOLUME | GAIN (LO) | GAIN (MID) | GAIN (HI) |
|---|---|---|---|---|
| 0ms | MID | 0.0 | 1.0 | 0.0 |
| 5ms | MID | 0.0 | 1.0 | 0.0 |
| 10ms | HI | 0.0 | 0.0 | 1.0 |
| 15ms | LO | 1.0 | 0.0 | 0.0 |

FIG. 7

| | | NUMBER OF CHANNELS OF INPUT SIGNALS | | | | | |
|---|---|---|---|---|---|---|---|
| | | 2ch (2/0) | 3ch (3/0) | 4ch (2/2) | 5ch (3/2) | 6ch (3/3) | 7ch (3/4) |
| NUMBER OF CHANNELS OF OUTPUT SIGNALS | 2ch (2/0) | NO PROCESSING | downmix | downmix | downmix | downmix | downmix |
| | 3ch (3/0) | FRONT EXTENSION PROCESSING | NO PROCESSING | downmix | downmix | downmix | downmix |
| | 4ch (2/2) | FRONT EXTENSION PROCESSING | FRONT EXTENSION PROCESSING | NO PROCESSING | downmix | downmix | downmix |
| | 5ch (3/2) | FRONT EXTENSION PROCESSING | FRONT EXTENSION PROCESSING | FRONT EXTENSION PROCESSING | NO PROCESSING | downmix | downmix |
| | 6ch (3/3) | FRONT EXTENSION PROCESSING | FRONT EXTENSION PROCESSING | FRONT EXTENSION PROCESSING | REAR EXTENSION PROCESSING | NO PROCESSING | downmix |
| | 7ch (3/4) | FRONT EXTENSION PROCESSING | FRONT EXTENSION PROCESSING | FRONT EXTENSION PROCESSING | REAR EXTENSION PROCESSING | REAR EXTENSION PROCESSING | NO PROCESSING |

SIGNAL PROCESSING DEVICE AND SIGNAL PROCESSING METHOD

CROSS-REFERENCE TO RELATED APPLICATION(S)

This application is based upon and claims the benefit of priority from prior Japanese patent application No. 2016-051220, filed on Mar. 15, 2016, the entire contents of which are incorporated herein by reference.

BACKGROUND

The present invention relates to a technique for generating multi-channel music signals from two-channel music signals.

A multi-channel surround technique is available in which a plurality of speakers is arranged so as to surround the listener and sound is output from the respective speakers so as to envelop the listener, thereby enhancing presence. As the arrangement positions of the respective speakers in the multi-channel surround technique, for example, five speakers including a center channel speaker C, a left front speaker L, a right front speaker R, a left surround speaker SL and a right surround speaker SR are arranged at the corresponding positions. The left front speaker L and the right front speaker R are arranged on the left side and the right side of the front respectively as viewed from the listener and are used for sound image localization on the front left side, the direct front and the front right side. The left surround speaker SL and the right surround speaker SR are arranged on the left side (or the left rear side) and the right side (or the right rear side) of the listener respectively and are used for sound image localization on the sides and the rear sides of the listener and for reproduction of non-localized sound. The center channel speaker C is arranged on the direct front of the listener and used to reproduce the sound localized on the front of the listener, for example, words of a movie. Although this kind of multi-channel surround technique has been used frequently, for example, for acoustic reproduction in movie theaters and the like, the technique is also used, for example, for acoustic reproduction in the so-called home theaters and video games.

Acoustic signals to be reproduced are required to conform to the multi-channel surround technique to perform acoustic reproduction being rich in presence in home theaters and video games. For this reason, even if, for example, a movie on a DVD (digital versatile disc) having been recorded by the related-art stereo system is reproduced by devices conforming to the multi-channel surround technique, the listener cannot enjoy sound with presence. Hence, for the purpose of solving this kind of problem, various techniques (hereafter referred to as up-mixing techniques) have been proposed in which the stereo audio signals of the left and right two-channels are processed beforehand so that the individual channel signals can be extracted and audio signals to be supplied to the respective speakers of a multi-channel surround system are generated. As the up-mixing techniques, Dolby Pro Logic (registered trade mark) and the technique disclosed in U.S. Pat. No. 7,003,467 are available, for example.

In the matrix signal processing of Dolby Pro Logic (registered trade mark), for example, the respective left and right two-channel audio signals (left channel audio signal and the right channel audio signal) are added (or subtracted) while being subjected to gain adjustment so as to generate an audio signal to be supplied to each speaker of the multi-channel surround system. For example, the audio signal to be supplied to the surround speaker is generated as the signal (L−R) obtained by subtracting the right-channel audio signal from the left channel audio signal. In this case, the audio signal to be supplied to the surround speaker is extracted as the opposite-phase component in the audio signals of the left and right channels.

Such an up-mixing technique as Dolby Pro Logic (registered trade mark) described above is suited for processing in which a plurality of signals including words and BGMs having been separated distinctly as in movie contents is down-mixed to left and right two-channel signals. On the other hand, in the case that channel extension is performed by carrying out the above-mentioned matrix signal processing for acoustic signals not subjected to down-mixing, such as ordinary music signals, a delay (effect) for intentionally shifting sound emission timing, for example, is erroneously determined as a signal of an opposite-phase component (surround channel), whereby there is a risk that unintentional reproduction processing may be carried out. Hence, a technique for generating multi-channel audio signals from two-channel acoustic signals, different from the above-mentioned up-mixing technique for use in movies and the like, is demanded.

SUMMARY

The present application has been proposed in consideration of the above-mentioned problem, and an object of the present invention is to provide a signal processing device and a signal processing method capable of generating multi-channel acoustic signals from two-channel acoustic signals.

According to as aspect of the invention, there is provided a signal processing device comprising: a calculating unit which is configured to perform calculation using a signal level of a first acoustic signal and a signal level of a second acoustic signal; a determining unit, based on a result of a comparison between: the signal level of at least one of the first acoustic signal and the second acoustic signal before the calculation; and a result of the calculation, which is configured to determine whether a component of a third acoustic signal to be output from a position between a position from which the first acoustic signal is output and a position from which the second acoustic signal is output is included in the first acoustic signal and the second acoustic signal; and a signal generating unit which is configured to generate the third acoustic signal from the first acoustic signal and the second acoustic signal when the determining unit is configured to determine that the component of the third acoustic signal is included in the first acoustic signal and the second acoustic signal.

BRIEF DESCRIPTION OF THE DRAWINGS

FIG. 4 is a table indicating conditions according to which a center component is extracted by a center component extraction section;

FIG. 6 is a table showing examples of gain values to be adjusted by a maximum level detection section in the case that the band having the maximum sound volume in the center component has changed;

FIG. 7 is a table indicating the combinations of the number of channels of input signals and the number of channels of output signals and also indicating processing contents required for changing the number of channels;

DETAILED DESCRIPTION OF EXEMPLARY EMBODIMENTS

<First Embodiment>

Figure 1:
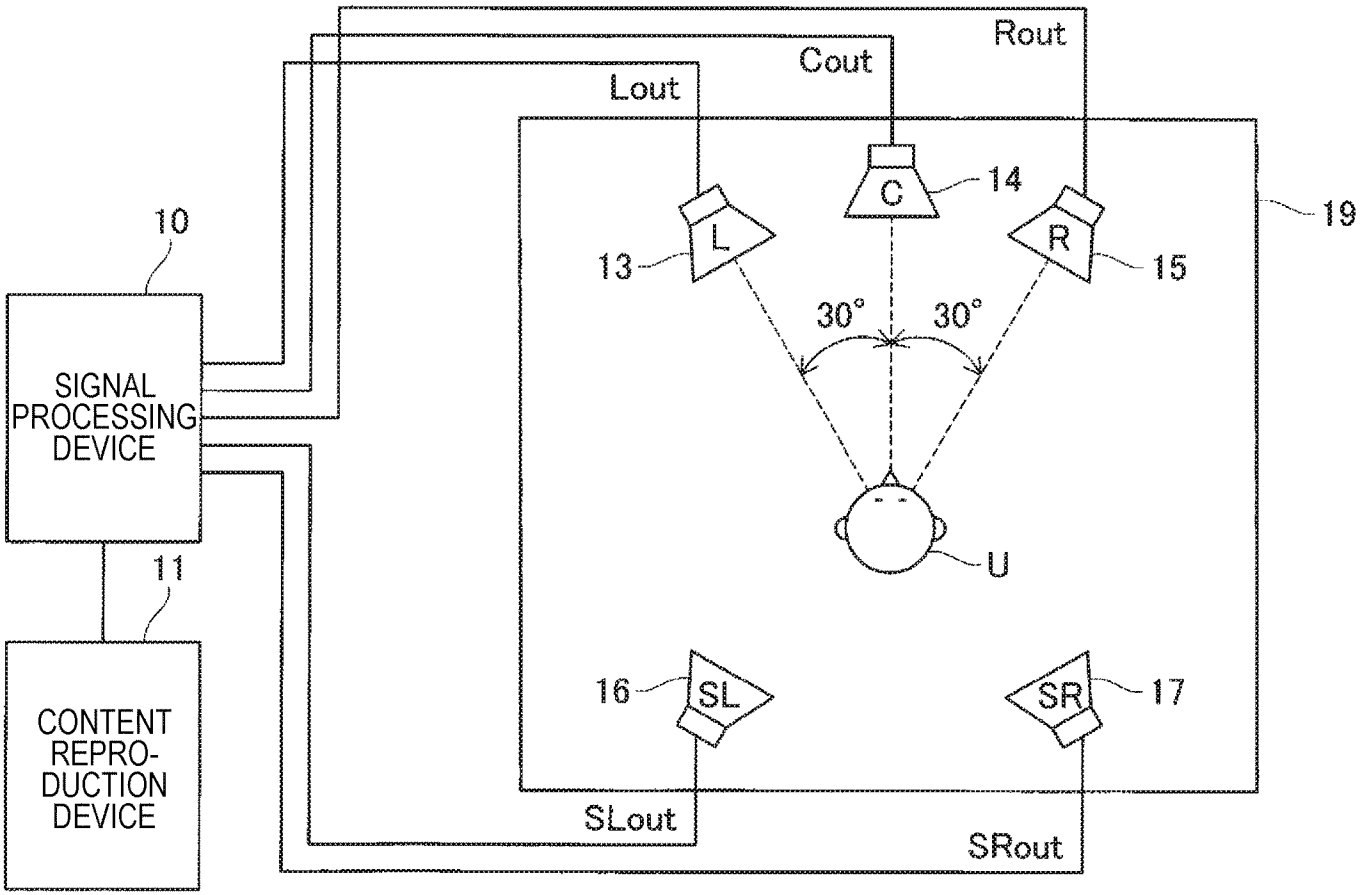
FIG. 1 is a schematic view showing the connection of a signal processing device and the arrangement of speakers according to a first embodiment.

An embodiment of a signal processing device according to the present invention will be described below. FIG. 1 is a schematic view showing the connection of the signal processing device and the arrangement of speakers according to a first embodiment. As shown in FIG. 1, a content reproduction device 11 and five speakers 13 to 17 are connected to a signal processing device 10. The content reproduction device 11 is a device for outputting various acoustic signals, such as an optical disc reproduction device for reproducing the sounds of CDs and DVDs or a TV tuner.

At the center of a listening room 19, the listener U listens to, for example, the music or the like output from the content reproduction device 11 and subjected to signal processing by the signal processing device 10. The signal processing device 10 according to the first embodiment receives, for example, two-channel stereo music signals (input signals Lin and Rin) from the content reproduction device 11 and generates multi-channel music signals, that is, five-channel music signals (output signals Lout, Rout, Cout, SLout and SRout). The signs L, C, R, SL and SR herein represent left, center, right, surround left and surround right, respectively. For example, the sign "Lin" represents the input signal at the left channel.

The signal processing device 10 outputs the center output signal Cout from the speaker 14. Furthermore, the signal processing device 10 outputs the front side output signals Lout and Rout, that is to say, the signal processing device 10 outputs the left output signal Lout from the speaker 13 and outputs the right output signal Rout from the speaker 15. Moreover, the signal processing device 10 outputs the surround channel output signals SLout and SRout, that is to say, the signal processing device 10 outputs the surround left output signal SLout from the speaker 16 and outputs the surround right output signal SRout from the speaker 17.

The speakers 13 to 17 are arranged around the listener U, for example, on the basis of "ITU-R BS.775 recommendations". For example, the center speaker 14 is arranged at the center between the left speaker 13 and the right speaker 15. The sound emission direction of the left speaker 13 is set so as to be rotated 30 degrees counterclockwise from the sound emission direction of the center speaker 14 with the listening position of the listener U at the center. Similarly, the sound emission direction of the right speaker 15 is set so as to be rotated 30 degrees clockwise from the sound emission direction of the center speaker 14 with the listening position of the listener U at the center.

<Generation of the Center Channel Output Signal Cout>

Figure 2:
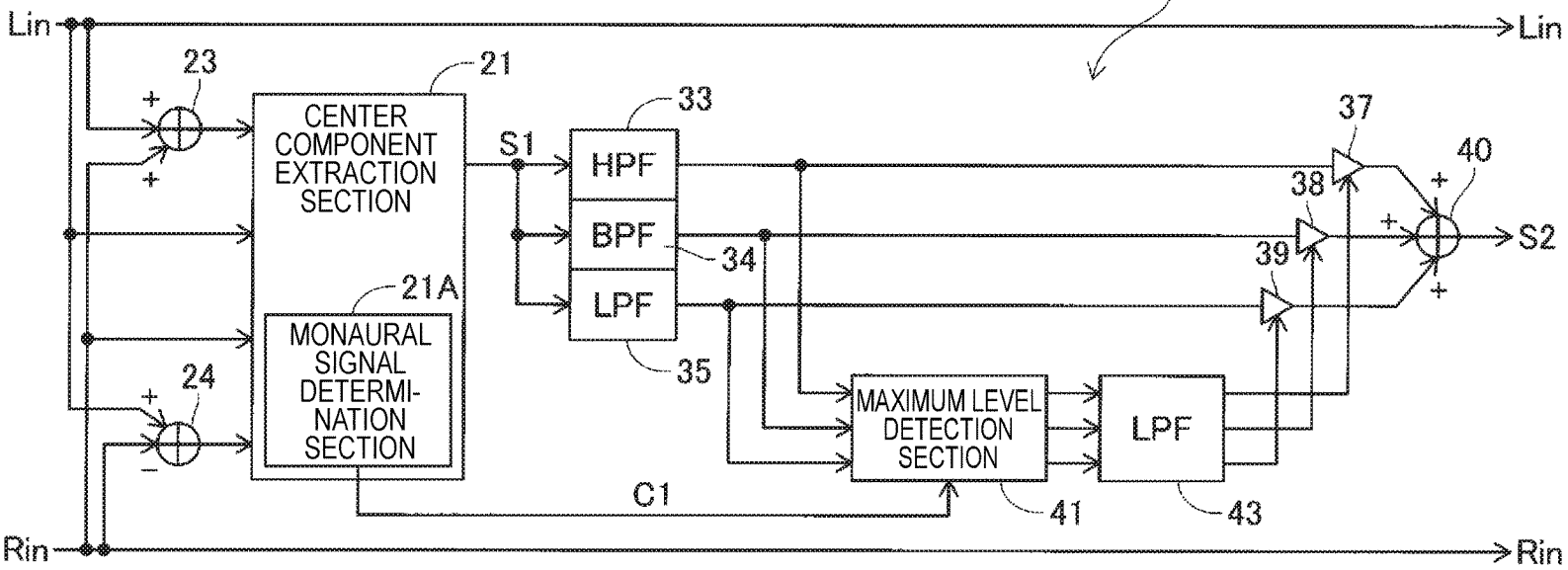
FIG. 2 is a block diagram showing the signal processing device according to the first embodiment.
Figure 3:
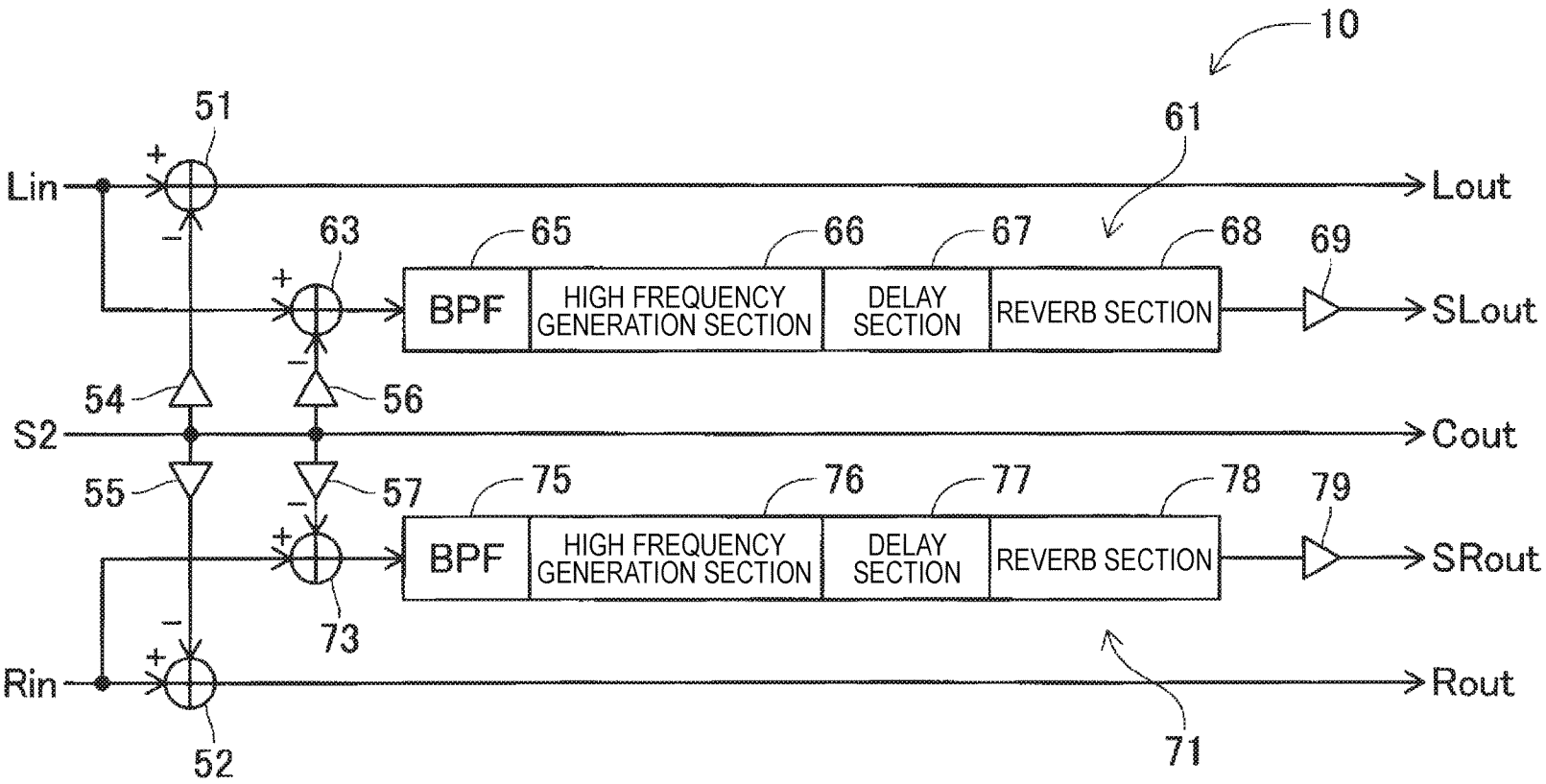
FIG. 3 is a further block diagram showing the signal processing device according to the first embodiment.

FIGS. 2 and 3 are block diagrams showing the signal processing device 10 according to the first embodiment. As shown in FIG. 2, the signal processing device 10 has a center component extraction section 21 and a specified band enhancement section 31. The center component extraction section 21, the specified band enhancement section 31, surround generation sections 61 and 71 (see FIG. 3) to be described later, etc. can be implemented, for example, when an acoustic processing DSP (digital signal processor) executes predetermined programs stored in a storage section, such as memory (not shown). The center component extraction section 21 extracts a signal S1 on the basis of which the output signal Cout of the center channel (Cch) is generated. The center component extraction section 21 generates the in-phase component of the input signals Lin and Rin as the original signal (signal S1) of the center channel.

When it is herein assumed that the center channel component included as the in-phase component in the input signals Lin and Rin is "C", that a surround channel component is "S" and that the generated L and R channel signals are the output signals Lout and Rout, the input signals Lin and Rin can be represented by the following expressions (1) and (2).

$$Lin=Lout+C+S \quad (1)$$

$$Rin=Rout+C+S \quad (2)$$

In the case of a music signal, a surround channel component, such as reverb (reverberation), can be assumed to be an in-phase component. Hence, the surround channel component (S) in the above-mentioned expressions is assumed to be an in-phase component and indicated with a plus sign.

In addition to the input signals Lin and Rin, the output signals of an adder 23 and a subtractor 24 are input to the center component extraction section 21. The input signals Lin and Rin are input to each of the adder 23 and the subtractor 24. The adder 23 outputs the added signal (Lin+Rin) of the input signals Lin and Rin to the center component extraction section 21. The subtractor 24 outputs the subtracted signal (Lin−Rin) obtained by subtracting the input signal Rin from the input signal Lin to the center component extraction section 21.

The center component extraction section 21 outputs, for example, the signal S1, that is, the in-phase component, as the original signal for generating the center channel signal (the output signal Cout) to the specified band enhancement section 31 provided on the latter stage. For example, the signal (Lin+Rin) can be used as the signal S1. The signal (Lin+Rin) is represented by the following expression using the above-mentioned expressions (1) and (2).

$$S1=Lin+Rin=(Lout+Rout+2S)+2C$$

The signal S1 includes a signal obtained by doubling (+6 dB) the amplitude of the center channel signal (component C).

Furthermore, in the case that the signal localized at the center is distributed to the L and R channels, for example, the center channel signal is usually attenuated by 3 dB (multiplied by 0.707) to form a phantom sound source between the left and right speakers using the sounds of the left and right speakers. Hence, the signal S1 is represented by the following expression (3). In the case that the same channel sound is transmitted to the listener from the left and right different directions with respect to the listener, a virtual sound source is localized in the intermediate direction between the different directions, and this virtual sound source is referred to as the phantom sound source $$S1=(Lin+Rin)*0.707 \quad (3)$$

The center component extraction section 21 outputs the signal S1 represented in the above-mentioned expression (3) to the specified band enhancement section 31. For example, in the case that the input signal Lin includes a 0.707 C center channel component and that the input signal Rin includes a 0.707 C center channel component, Lin+Rin=(0.707+0.707) C=1.41 C is obtained.

Moreover, before extracting the signal S1, the center component extraction section 21 determines whether the center component is included in the input signals Lin and Rin. The center component extraction section 21 according to the first embodiment determines whether the center component is included on the basis of the four conditions (the first to fourth conditions) shown in the table of FIG. 4.

FIG. 4 shows four examples (No. 1 to No. 4) of the amplitude values of the input signals Lin and Rin and indicates the results ("○" or "x") of the determination as to whether the amplitude values in the respective examples satisfy the four conditions (the first to fourth conditions). The center component extraction section 21 calculates the amplitude values shown in FIG. 4 for each sample of the input signals Lin and Rin, for example. Alternatively, the amplitude values may be calculated after samples are stored in a buffer during a predetermined time (corresponding to a predetermined number of samples) to reduce a processing load. In this case, the maximum value or the effective value of each of the input signals Lin and Rin within the predetermined time may be calculated as the amplitude value. Furthermore, "○" in FIG. 4 indicates that each condition is satisfied. Moreover, "x" indicates that each condition is not satisfied. What's more, the values of Lin, Rin, (Lin+Rin), (Lin−Rin) in FIG. 4 are absolute values.

The first condition "(Lin+Rin)>Lin" indicates that the amplitude value of the signal amounting to two times (+6 dB) the center component is larger than that of the input signal Lin. Furthermore, the second condition "(Lin+Rin) >Rin" indicates that the amplitude value of the signal amounting to two times the center component is larger than that of the input signal Rin. Moreover, the third condition "(Lin−Rin)<Lin" indicates that the amplitude value of the signal from which the center component is removed is smaller than that of the input signal Lin. Still further, the fourth condition "(Lin−Rin) <Rin" indicates that the amplitude value of the signal from which the center component is removed is smaller than that of the input signal Rin. In the case that these four conditions (the first to fourth conditions) are all satisfied, the center component extraction section 21 according to this embodiment determines that the center channel component is included in each of the input signal Lin and Rin and outputs the above-mentioned signal S1 to the specified band enhancement section 31 provided on the latter stage.

The conditions shown in FIG. 4 are examples and can be changed as necessary. For example, in the examples shown in FIG. 4, in the cases of No. 1 and No. 2 in which the four conditions are satisfied, the center component extraction section 21 outputs the signal S1. The signal S1 that is desired to be extracted as the center channel signal is preferably an in-phase component of the input signals Lin and Rin being identical or almost identical to each other. For this reason, the signal S1 is preferably output only in the case of No. 1 (both the amplitude values of Lin and Rin are "0.5") in FIG. 4. Hence, the conditions may be changed by adding a coefficient, for example, by changing the (Lin+Rin) in the first condition and the second condition to (Lin+Rin)*0.6. Conversely, for example, in the case that the signal S1 is also desired to be output in No. 3 as in the cases of No. 1 and No. 2, this can be accomplished by changing (Lin−Rin) in the third condition and the fourth condition to (Lin−Rin)*0.25. Furthermore, the center component extraction section 21 may determine that the center component is present in the case that at least one of the four conditions (the first to fourth conditions) is satisfied.

Figure 5:
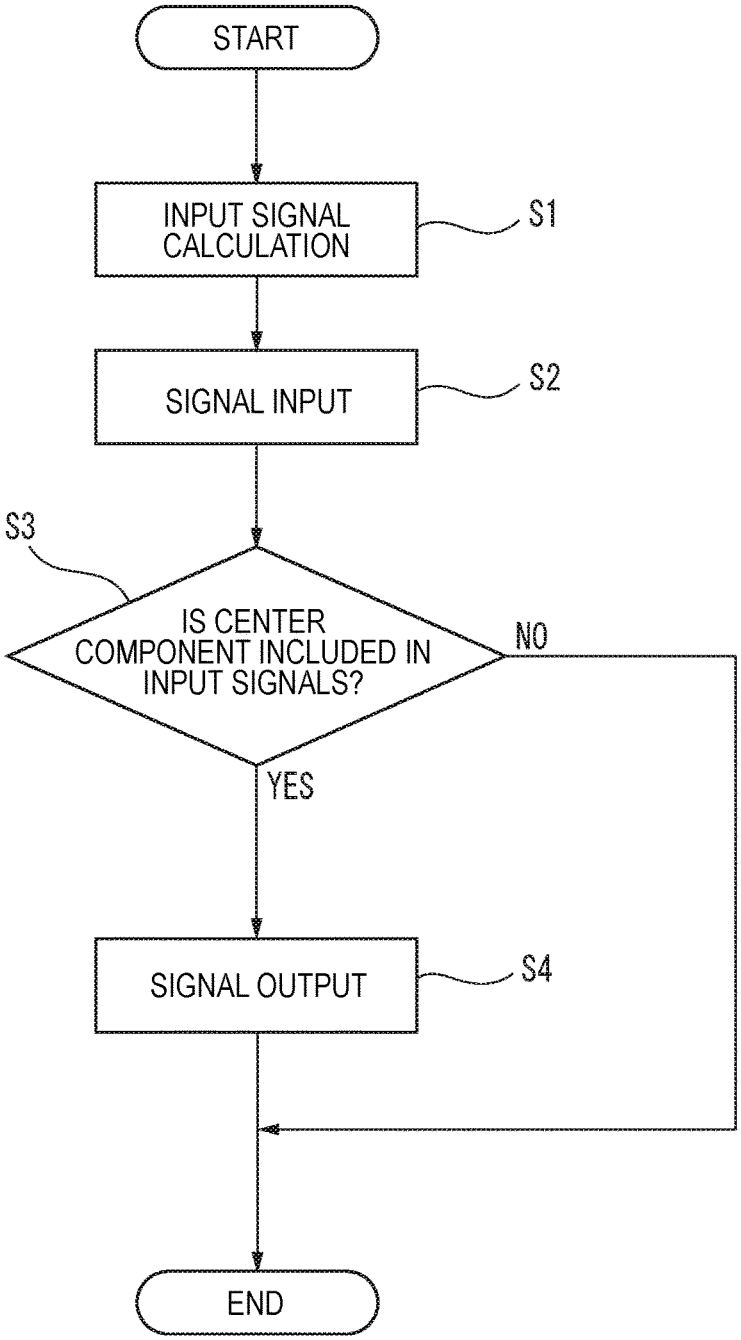
FIG. 5 is a flowchart showing a processing for generating the original signal of the center channel from input signals.

FIG. 5 is a flow chart showing the processing for generating the signal S1 on the basis of which the output signal Cout of the center channel is generated from the input signals Lin and Rin. The input signals Lin and Rin are input to the adder 23 and the subtractor 24 and calculated by the adder 23 and the subtractor 24 (at step S1). In addition to the input signals Lin and Rin, the signal (Lin+Rin) calculated by the adder 23 and output therefrom and the signal (Lin−Rin) calculated by the subtractor 24 and output therefrom are input to the center component extraction section 21 (at step S2). The center component extraction section 21 determines whether the center component is included in the input signals Lin and Rin (at step S3). More specifically, a determination is made as to whether the amplitude values of the input signals Lin and Rin satisfy the four conditions (the first to fourth conditions). In the case that the amplitude values of the input signals Lin and Rin satisfy the four conditions (the first to fourth conditions), it is determined that the center channel component is included in the input signals Lin and Rin (YES at step S3), and the signal S1 is output from the center component extraction section 21 to the specified band enhancement section 31 (at step S4).

<Other Conditions>

Furthermore, the center component extraction section 21 can use other conditions in addition to or instead of the four conditions for the above-mentioned addition and subtraction. For example, in the case that the sound volumes of the input signals Lin and Rin are small, the center component extraction section 21 may determine that the center channel component is included in the input signals Lin and Rin. For example, voice in a vocal is not included in the introduction and interlude thereof and the sound volume tends to become small. In this case, in the above-mentioned first to fourth conditions, the sound volumes (amplitude values) of the input signals Lin and Rin become too small, whereby there is a risk that it is determined that the center component is not present. Hence, in the case that the sound volumes of the input signals Lin and Rin are not more than a reference value (for example, −20 dB), the center component extraction section 21 may output the signal S1 assuming that the center component is included.

Next, the specified band enhancement section 31 will be described. As shown in FIG. 2, the specified band enhancement section 31 has three filters 33, 34 and 35, amplifiers 37, 38 and 39 corresponding to the respective filters 33 to 35, an adder 40, a maximum level detection section 41, and a low-pass filter 43. The specified band enhancement section 31 divides the signal S1 supplied from the center component extraction section 21 into, for example, three frequency bands: high, middle and low frequency bands, and extracts, from the three frequency bands, only the signal in the frequency band having the largest sound volume as the center signal. For example, in the case of a music signal in which vocal sounds are predominant, the sound volume in the middle frequency band rises, and in the case of a bass solo part, for example, the sound volume in the low frequency band rises. Accordingly, the specified band enhancement section 31 detects the frequency band having the maximum sound volume from the sound volumes changing in each reproduction time, and outputs the sound of the frequency band as the output signal Cout of the center channel, thereby emphasizing the sound in the appropriate frequency band.

More specifically, the signal S1 (=(Lin+Rin)*0.707) is input from the center component extraction section 21 to the filters 33, 34 and 35 of the specified band enhancement section 31. The filter 33 is a high pass filter for extracting the high frequency band of the signal S1 and outputs the extracted signal to the amplifier 37. The filter 34 is a bandpass filter for extracting the middle frequency band of the signal S1 and outputs the extracted signal to the amplifier 38. The filter 35 is a low pass filter for extracting the low frequency band of the signal S1 and outputs the extracted signal to the amplifier 39. The adder 40 adds the signals input from the amplifiers 37 to 39 and outputs the obtained signal as the output signal Cout of the center channel (refer to the output signal S2 in FIGS. 2 and 3).

Furthermore, the filters 33, 34 and 35 also output the signals extracted from the signal S1 to the maximum level detection section 41. The maximum level detection section 41 detects the signal in the frequency band having the maximum sound volume from the signals supplied from the filters 33, 34 and 35. The maximum level detection section 41 adjusts the gain values of the amplifiers 37 to 39 so that the signal in the frequency band having the maximum sound volume is selectively output.

FIG. 6 shows examples of the gain values in the case that the frequency band having the maximum sound volume in the signal S1 has changed. An elapsed time value at every 5 ms and the frequency band having the maximum sound volume in the signal S1 at each time are indicated as examples at the two left columns. The gain value (HI), the gain value (MDI) and the gain value (LO) shown in FIG. 6 respectively represent the gain values of the amplifiers 37, 38 and 39 shown in FIG. 2 in this order.

As shown in FIG. 6, when the elapsed time value is 0 ms, the sound volume in the middle frequency band (MID) becomes the maximum. In this case, the maximum level detection section 41 sets the gain value of the frequency band (MID) having the maximum sound volume to 1.0 (attenuation amount: 0 dB) and sets the gain values of the other frequency bands (the low frequency band (LO) and the high frequency band (HI)) to 0.0 (attenuation amount: −∞db). Hence, the sounds in the low and high frequency bands are muted, and the sound in the middle frequency band is emphasized. Similarly, when the elapsed time value is 10 ms, the sound volume in the high frequency band (HI) becomes the maximum, and the maximum level detection section 41 sets the gain value of the high frequency band to 1.0 and sets the gain values of the other frequency bands (the low frequency band (LO) and the middle frequency band (MID)) to 0.0. Also in the case that the sound volume in the low frequency band (LO) is the maximum, the maximum level detection section 41 performs similar processing (refer to the row indicating the elapsed time value 15 ms in FIG. 6)

The low-pass filter 43 is used to smooth the steep change in the gain value output from the maximum level detection section 41. For example, in FIG. 6, when the elapsed time value changes from "5 ms" to "10 ms", the gain value of the amplifier 37 corresponding to the high frequency band changes from "0.0" to "1.0". In this case, the maximum level detection section 41 outputs the gain value to the amplifier 37 via the low-pass filter 43, thereby smoothly changing the gain value ("0.0→0.1 →0.2→ . . . →1.0"), thereby suppressing the output (the sound volume of the high frequency band signal of the center channel) of the amplifier 37 from rising steeply. This prevents a situation in which the sound of the center channel changes steeply and a sense of discomfort is given to the listener.

In the maximum level detection section 41, the time constant of the low-pass filter 43 at the time when the center component (the signal S1) is detected may be changed from the time constant thereof at the time when the center component is lost. In the case that the center component extraction section 21 detects the center component, the maximum level detection section 41 changes the time constant of the low-pass filter 43 (for example, to 100 ms/6 dB) to quicken the response, thereby changing the gain value relatively steeply. As a result, even in the case that the signal in the frequency band having the maximum sound volume is changed repeatedly in a short time, the accuracy of center channel detection can be raised by raising the speed of the reaction. On the other hand, in the case that the center component extraction section 21 has stopped detecting the center component, the maximum level detection section 41 changes the time constant of the low-pass filter 43 (for example, to 500 ms/6 dB) to slow the response, thereby changing the gain value relatively gradually. As a result, the sound of the center channel can be made small gradually (fade out).

Furthermore, in the case that the input signals Lin and Rin are monaural signals, the center component extraction section 21 may control the maximum level detection section 41 so that the signals in all the frequency bands are output as the output signal S2 (the output signal Cout). In the case that the input signals Lin and Rin are monaural signals, the input signals Lin and Rin become identical or almost identical to each other. In this case, the sounds in all the frequency bands are preferably output as the sound of the center channel, without emphasizing the specific frequency bands of the input signals Lin and Rin.

As shown in FIG. 2, the center component extraction section 21 has a monaural signal determination section 21A for determining whether the input signals Lin and Rin are monaural signals. For example, in the case that the center component extraction section 21 detects the center component according to the above-mentioned conditions and that the result of the subtraction (Lin−Rin) between the amplitude values is zero or almost zero, the monaural signal determination section 21A outputs a control signal C1 to the maximum level detection section 41. Upon receiving the control signal C1, the maximum level detection section 41 sets the gain values of all the frequency bands (the amplifiers 37 to 39) to "1.0", for example. Hence, in the case that the input signals Lin and Rin are monaural signals, the specified band enhancement section 31 outputs the signals of all the frequency bands from the center channel. The monaural signal determination section 21A, however, may directly control the gain values of the amplifiers 37 to 39.

<Generation of the Output Signals Lout and Rout of the Front Channel>

As shown in FIG. 3, the signal processing device 10 has a subtractor 51 corresponding to the output signal Lout, a subtractor 52 corresponding to the output signal Rout, amplifiers 54, 55, 56 and 57, etc. The amplifier 54 adjusts the signal level of the output signal S2 of the adder 40, i.e., the output signal Cout of the center channel, and outputs the signal to the subtractor 51. The subtractor 51 subtracts the output signal S2 (the output signal Cout) generated by the center component extraction section 21 and the specified band enhancement section 31 from the original input signal Lin and outputs the obtained signal as the output signal Lout of the L channel.

Similarly, the amplifier 55 adjusts the signal level of the output signal S2 of the adder 40, and outputs the signal to the subtractor 52. The subtractor 52 subtracts the output signal S2 from the original input signal Rin and outputs the obtained signal as the output signal Rout of the R channel. Hence, the signal processing device 10 generates the signals obtained by removing the center component from the input signals Lin and Rin as the L and R channel signals, whereby the number of the channels can be extended.

<Generation of the Output Signals SLout and SRout of the Surround Channels>

As shown in FIG. 3, the signal processing device 10 has the surround generation section 61 for generating the output signal SLout and the surround generation section 71 for generating the output signal SRout. In the case of a signal having a small amount of opposite-phase component, that is, in the case of an ordinary music signal different from a signal that is supposed to be subjected to matrix signal processing so that a surround component is extracted, the output signals SLout and the SRout of the surround channels can be generated on the basis of the output signals Lout and Rout having been generated by the above-mentioned processing. The surround generation sections 61 and 71 according to this embodiment generate, as the output signals SLout and SRout of the surround channels, signals in which an indirect sound is emphasized so as to impart a spreading effect in comparison with the output signals Lout and Rout on the front side.

The surround generation section 61 has a subtractor 63, a bandpass filter 65, a high frequency generation section 66, a delay section 67, a reverb section 68 and an amplifier 69. The amplifier 56 corresponding to the SL channel adjusts the signal level of the output signal S2 of the adder 40 (see FIG. 2) and outputs the signal to the subtractor 63. The subtractor 63 subtracts the output signal S2 from the input signal Lin and outputs the obtained signal to the bandpass filter 65.

The bandpass filter 65 removes sounds, such as vocal sounds in the frequency bands easily perceived by the human ears, thereby imparting, to the input signal, an indirect sound like effect such that sounds are generated in the distance. Furthermore, the high frequency generation section 66 adds a harmonic wave to the input signal, thereby generating a sound similar to the output signal Lout on the front side. Hence, for example, even a speaker incapable of reproducing low frequency band signals can impart a perception to the listener as if the listener could hear the low frequency band signals. However, the high frequency generation section 66 may generate, for example, a harmonic wave from the input signal Lin.

The delay section 67 imparts a delay to the input signal so that the phase of the signal is made opposite, thereby lowering the correlation with the front side and imparting such an effect that the listener does not distinguish where the sound is generated. Alternatively, the delay section 67 can also generate a Haas effect so that the sound on the front side is heard to be more emphasized to the listener by adding a delay to the input signal.

The reverb section 68 is used to impart a reverb effect to the input signal and imparts a depth feeling to the sound of the output signal SLout of the surround channel in comparison with the sound of the output signal Lout on the front side. Besides, the surround generation section 61 adjusts the signal level of the signal having been processed by the bandpass filter 65 and other devices by using the amplifier 69, and outputs the obtained signal as the output signal SLout of the surround channel on the left side.

The surround generation section 71 has a configuration similar to that of the surround generation section 61 and has a subtractor 73, a bandpass filter 75, a high frequency generation section 76, a delay section 77, a reverb section 78 and an amplifier 79. The surround generation section 71 imparts various effects to the output signal SRout as in the case of the surround generation section 61.

<The Other Channels>

Although the five channel signals are generated from the input signals Lin and Rin of the L and R channels in the above-mentioned signal processing device 10, the signals to be generated are not limited to these signals, but the other channel signals may also be generated. For example, the signal processing device 10 may generate surround back channel signals from the input signals Lin and Rin. As the surround back channel signals, the same signals as the surround channel signals (the output signals SLout and SRout) or signals obtained by adding delays to the surround channel signals so as to be lowered in correlation can be used.

The signal processing device 10 may generate surround back channel signals (an example of a third music signal) by extracting the in-phase component of the output signals SLout and SRout (examples of a first music signal and a second music signal) of the surround channels using an algorithm similar to the method for generating the center channel output signal Cout from the input signals Lin and Rin. With this generation method, for example, 7.1 channel music signals can be generated by generating surround back channel signals from the surround channels of 5.1 channel music signals.

FIG. 7 indicates the combinations of the number of channels of input signals and the number of channels of output signals and also indicates processing contents required for changing the number of channels. The horizontal rows of FIG. 7 indicate the number of channels of the input signals. The vertical rows indicate the number of channels of the output signals. The numeral (for example, 2/0) indicated below the number of channels indicate (the number of channels on the front side/the number of channels on the rear side). Furthermore, "front extension processing" indicated in the figure indicates that the number of channels on the front side is required to be extended. Moreover, "rear extension processing" indicates that the number of channels on the rear side is required to be extended. Besides, "entire extension processing" indicates that the number of channels on both the front side and the rear side are required to be extended. What's more, "no processing required" indicates that extension processing is not required. Still further, "downmix" indicates that down-mixing is required.

For example, in the case of generating three channel output signals from two channel input signals, this can be accomplished by generating a Cch channel signal from the Lch and Rch signals (front extension processing). Furthermore, in the case of generating five channel output signals from three channel input signals, this can be accomplished by generating SLch and SRch signals from the Lch and Rch signals (front extension processing). In this case, it may be possible that the three channel input signals are down-mixed once to two channel signals and then extended to five channel signals.

Furthermore, in the case of generating seven channel output signals from five channel input signals in a manner similar to that described above, this can be accomplished by generating surround back (SB) channel signals from the surround channel (SL and SR) signals (rear extension processing). Moreover, in the case that the number of the surround back (SB) channels is only one as in the case that the number of the input channels is six, the number of channels can be extended to seven channels by distributing an SBch signal to surround back left (SBL) and surround back right (SBR) (rear extension processing). However, in the case that the processing load of the rear extension processing is large, the SLch and SRch signals may directly be distributed to the SBLch and SBRch signals.

Moreover, in the case of signals not including the center and surround back components as in the case of four channel signals, the number of channels can be extended to six channels by generating the Cch signal from the Lch and Rch signals and by generating the SBch signal from the SLch and SRch signals (entire extension processing).

In addition, the signal processing device 10 may generate signals to be output from height speakers or wide speakers from the input signals Lin and Rin. For example, signals obtained by removing low frequency signals from the surround channel signals by applying a virtual technique that emphasizes high frequency signals to localize sound images at upper positions may be generated as the signals to be output from rear height speakers. Furthermore, surround channel signals extracted without being subjected to opposite-phase processing may also be generated as the signals for front height speakers. This may be assumed to enhance a sense of unity of the sounds output from the speakers on the front side. Moreover, signals for the height speakers may also be generated by applying a characteristic that the sound image of the sound of the center signal is generally localized in the front upper direction and by mixing the center signal with a given signal. What's more, the surround channel signals may also be directly used as signals for wide speakers.

With the signal processing device 10 according to the first embodiment described above, channel extension can be accomplished by generating signals corresponding to the respective components from ordinary music signals (the input signals Lin and Rin) that are not supposed to be subjected to the matrix signal processing, whereby sounds without uncomfortable feeling can be generated. Furthermore, with this extension processing, complicated decoding processing or the like is not required, whereby the channel extension processing can be simplified and the time required for the processing can be shortened.

Although a music signal not supposed to be subjected to the matrix signal processing is taken as an example of an acoustic signal according to the present application in the first embodiment described above, the acoustic signal according to the present application is not limited to such a music signal. As the acoustic signal according to the present application, various acoustic signals, such as acoustic signals for TV broadcasts, can be adopted, provided that the signals are not supposed to be subjected to the matrix signal processing.

<Second Embodiment>

Next, a signal processing device 10A according to a second embodiment will be described referring to FIGS. 8 and 9. In the first embodiment, the input signals Lin and Rin of the L and R channels are added and made monaural once and then divided into frequency bands. On the other hand, the second embodiment is different from the first embodiment in that the input signals Lin and Rin of the L and R channels are individually divided into frequency bands to generate the output signal Cout of the center channel. In the following descriptions, components similar to those of the first embodiment described above are designated by the same numerals and signs, and their descriptions are omitted as necessary.

Figure 8:
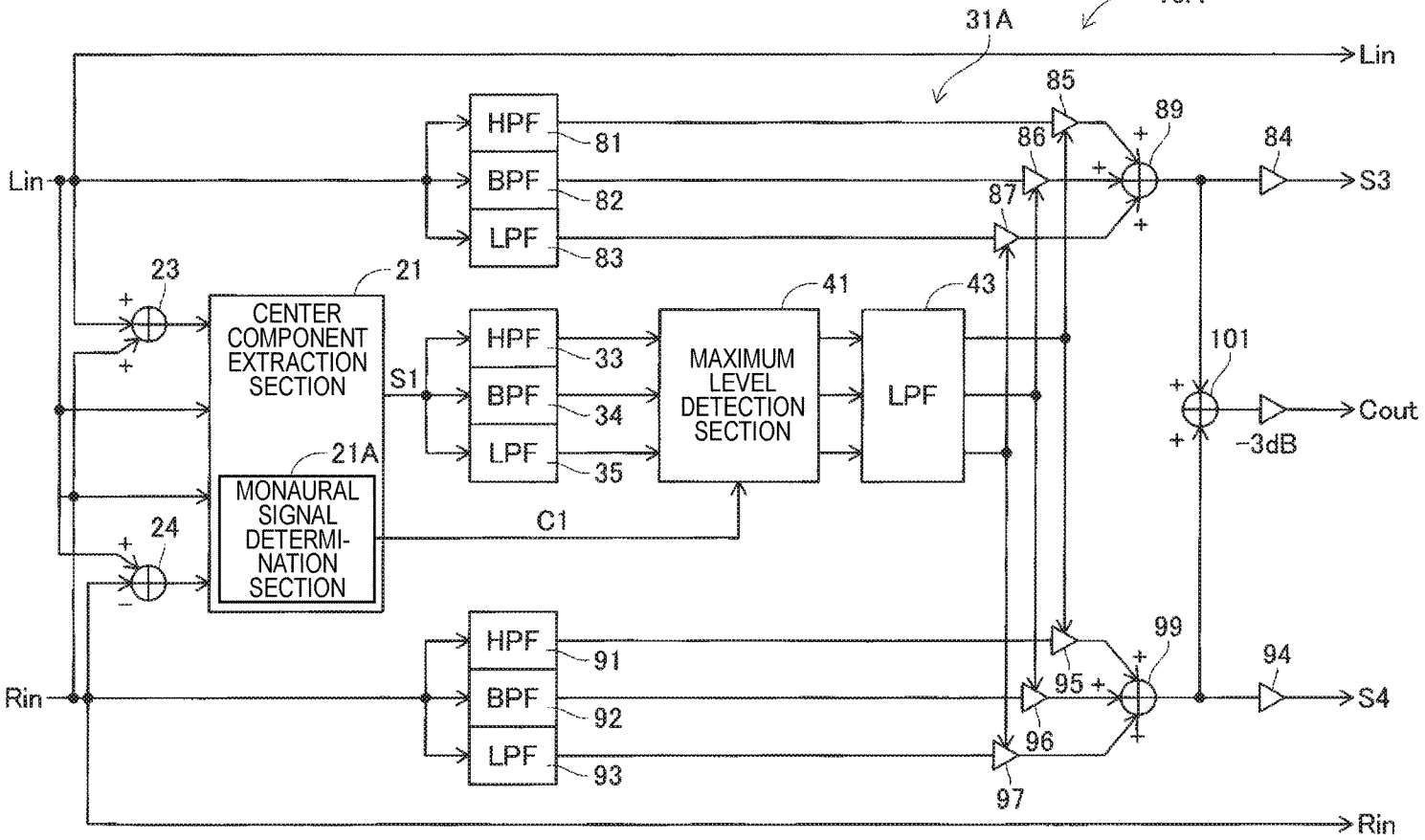
FIG. 8 is a block diagram showing a signal processing device according to a second embodiment.

As shown in FIG. 8, the signal S1 is input from the center component extraction section 21 to the specified band enhancement section 31A of the signal processing device 10A and divided into frequency bands by the filters 33 to 35. The frequency band having the maximum sound volume is detected by the maximum level detection section 41.

Furthermore, like the filters 33 to 35, filters 81, 82 and 83 corresponding to the L channel divide the input signal Lin into high, middle and low frequency bands. The filters 81, 82 and 83 divide the input signal Lin into frequency band signals and output the frequency band signals to amplifiers 85, 86 and 87. An adder 89 adds all the output signals of the amplifiers 85 to 87.

Similarly, filters 91, 92 and 93 corresponding to the R channel divide the input signal Rin into frequency band signals and outputs the frequency band signals to amplifiers 95, 96 and 97. An adder 99 adds all the output signals of the amplifiers 95 to 97. Moreover, the maximum level detection section 41 outputs the gain value for emphasizing the frequency band having the maximum sound volume to the outputs of the respective amplifiers 85 to 87 on the L side and the respective amplifiers 95 to 97 on the R side via the low-pass filter 43. Hence, the L and R channels can be individually processed and the center component can be extracted.

The level of the output signal of the adder 89 on the L side is adjusted by an amplifier 84, and the signal is output as a single S3. Furthermore, the level of the output signal of the adder 99 on the R side is adjusted by an amplifier 94, and the signal is output as a single S4. Moreover, an adder 101 adds the output signals of the adders 89 and 99. The output signal of the adder 101 is attenuated by 3 dB and output as the output signal Cout of the center channel.

Figure 9:
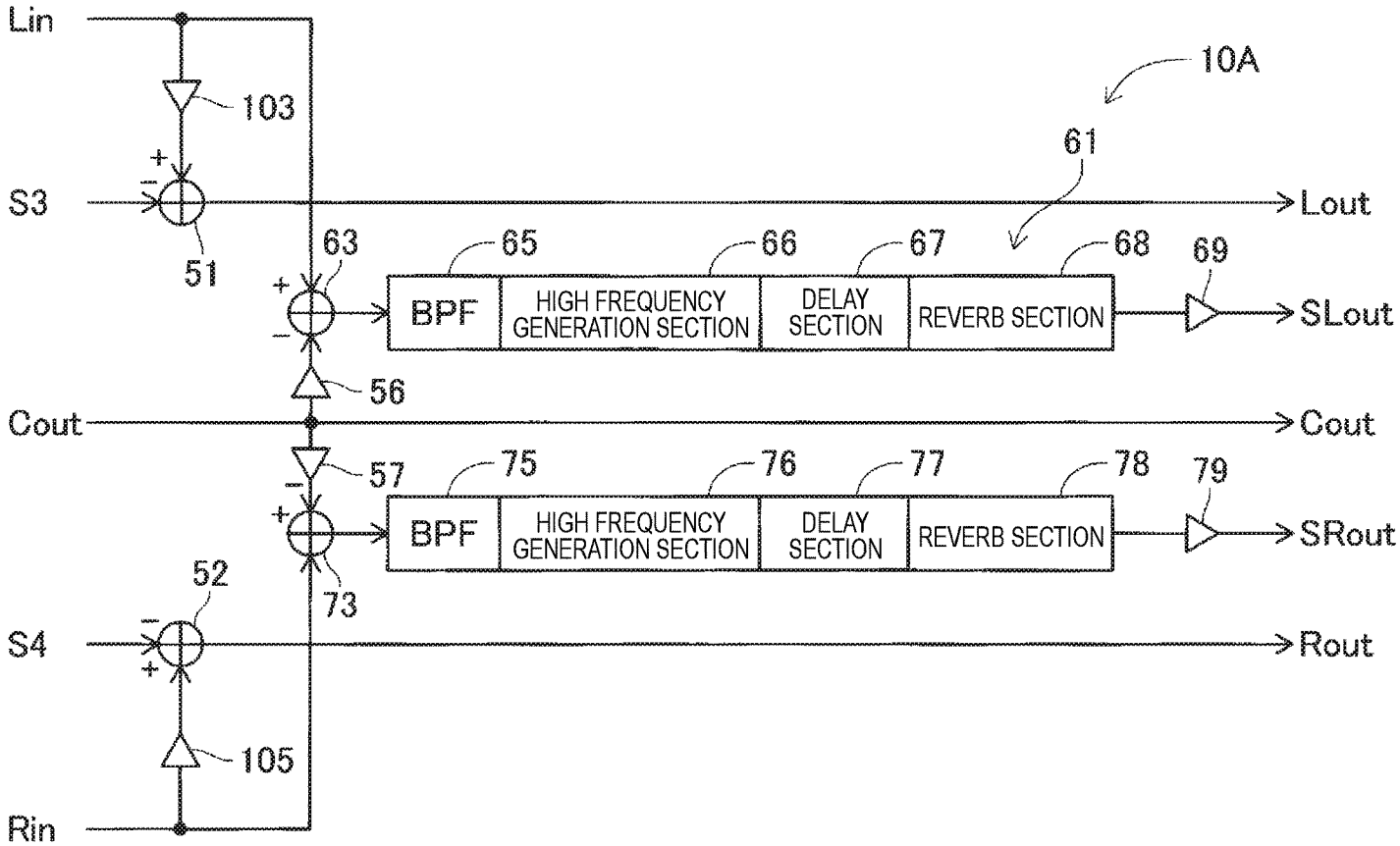
FIG. 9 is a further block diagram showing the signal processing device according to the second embodiment.

As shown in FIG. 9, the subtractor 51 on the L side subtracts the center component (the signal S3) corresponding to the L channel from the input signal Lin, the signal level of which has been adjusted by an amplifier 103, thereby generating the output signal Lout. Hence, in the signal processing device 10A according to the second embodiment, the input signals Lin and Rin of the L and R channels are added and made monaural, and then separately subjected to center component extraction processing for each channel without being subjected to band division. As a result, the output signal Lout of the L channel is generated separately from the signal of the R channel, whereby the separation property of the output signal Lout of the L channel from the output signal Rout of the R channel is enhanced and the influence of the output signal Rout of the R channel is reduced.

Similarly, the subtractor 52 on the R side subtracts the center component (the signal S4) corresponding to the R channel from the input signal Rin, the signal level of which has been adjusted by an amplifier 105, thereby generating the output signal Rout. Hence, the influence of the output signal Lout of the L channel to the output signal Rout is reduced. It may be possible that a signal processing device is configured so as to be equipped with both the processing circuits of the signal processing device 10 according to the first embodiment and the processing circuits of the signal processing device 10A according to the second embodiment. In this case, for example, a configuration may be used in which, according to the load to be processed, a selection is made as to whether the L and R channel signals are individually divided into frequency bands or the L and R channel signals are made monaural and then divided into frequency bands.

<Third Embodiment>

Next, a signal processing device 10C according to a third embodiment will be described referring to FIG. 10. The signal processing device 10C according to the third embodiment performs the extension processing of a signal that is supposed to be subjected to the matrix signal processing. By the use of the fact that, when the opposite-phase signal of the L channel signal is output from the R channel, the signal is generally not localized, this kind of signal is assumed to be a surround component (S) and used for matrix decoders for movies. On the other hand, the R channel signal in an ordinary music signal to be subjected to the processing of the first embodiment described above rarely includes the opposite-phase component of the L channel, whereby a surround signal can be generated from the L and R channel signals.

Hence, in the case that a signal such as a movie signal, the opposite-phase component of which is supposed to be extracted by the matrix signal processing, is extended, if the opposite-phase component is output from the L and R channels on the front side serving as the main channels, an unnatural sound is output. For this reason, in the signal processing device 10C according to the third embodiment, in the case that the input signals Lin and Rin include an opposite-phase component, the opposite-phase component is output from the surround channels instead of the L and R channels.

Figure 10:
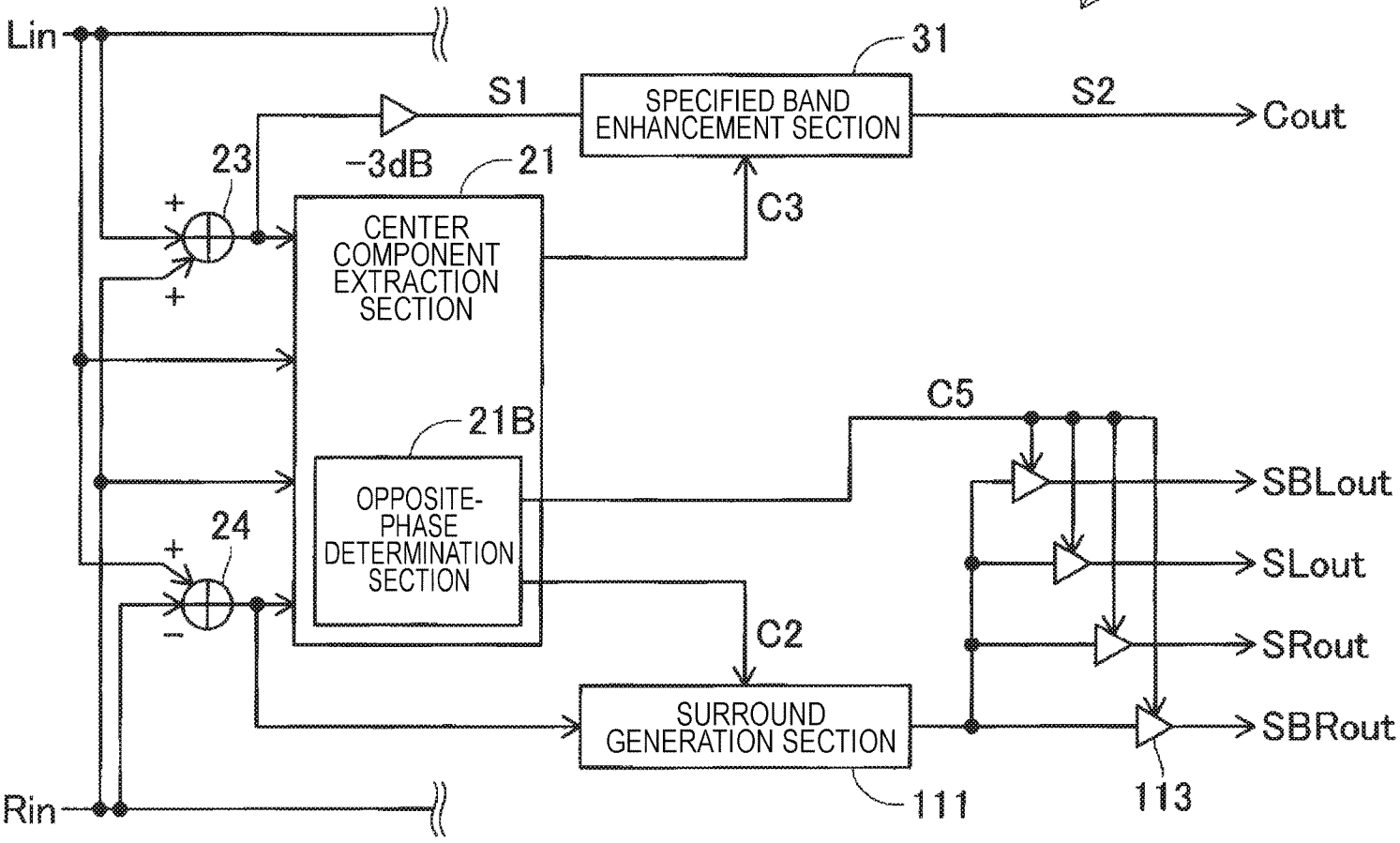
FIG. 10 is a block diagram showing a signal processing device according to a third embodiment.

FIG. 10 corresponds to FIG. 2 and only shows portions required for the generation of the signals of the surround channels. Furthermore, the signal processing device 10C generates the output signals SBLout and SBRout of the surround back left and right channels in addition to the output signals SLout and SRout of the surround left and right channels as the signals of the surround channels. Illustrations and descriptions of components similar to those of the signal processing device 10 according to the first embodiment are omitted as necessary.

As shown in FIG. 10, the center component extraction section 21 of the signal processing device 10C has an opposite-phase determination section 21B for determining whether an opposite-phase component is included in the input signals Lin and Rin. As in the case of the center channel signal processing according to the first embodiment, the opposite-phase determination section 21B determines that the surround component serving as a non-localized component is included in the input signals Lin and Rin in the case that all the following three conditions (first to third conditions) are all satisfied.

$(Lin-Rin)>Lin$ First condition $(Lin-Rin)>Rin$ Second condition $(Lin-Rin)>(Lin+Rin)$ Third condition Lin, Rin, Lin+Rin and Lin−Rin in the above-mentioned determination conditions are all absolute values.

In the case that the surround component is included abundantly, the signal processing device 10C directly outputs the difference (Lin−Rin) between the input signals Lin and Rin as the output signals SLout, SRout, SBLout and SBRout of the surround channels.

For example, in the case that the in-phase center channel component"C" and the opposite-phase surround channel component "S" are included in the input signals Lin and Rin, the input signals Lin and Rin can be represented by the following expressions.

$$Lin=Lout+C+S$$

$$Rin=Rout+C+S$$

In this case, as the result of the calculation of the difference (Lin−Rin) between the input signals Lin and Rin, the component of the surround channel becomes "2S", whereby the amplitude of the component is doubled and the component is amplified.

Hence, the above-mentioned first condition indicates that the signal (Lin−Rin) in which the surround component (opposite-phase component) is emphasized is higher in level than the input signal Lin of the L channel. Furthermore, the second condition indicates that the signal (Lin−Rin) in which the surround component (opposite-phase component) is emphasized is higher in level than the input signal Rin of the R channel. Moreover, the third condition indicates that the signal (Lin−Rin) in which the surround component (opposite-phase component) is emphasized is higher in level than the signal in which the center component (in-phase components) is emphasized. For example, in the case that the three conditions (the first to third conditions) are all satisfied, the opposite-phase determination section 21B outputs a control signal C2 to cause a surround generation section 111 to generate surround channel signals.

The surround component signal (Lin−Rin) is input from the subtractor 24 to the surround generation section 111. The surround generation section 111 has a configuration similar to, for example, that of the surround generation section 61 shown in FIG. 3 and imparts an effect such as reverb to the input signal. The signal processed by the surround generation section 111 is output as output signals SLout, SRout, SBLout and SBRout via amplifiers 113 provided corresponding to the respective channels to perform level adjustment.

In addition, like the signal processing device 10 according to the first embodiment described above, the signal processing device 10C has the specified band enhancement section 31 for generating a center component. The signal ((Lin+Rin)*0.707) obtained by attenuating the output signal (Lin+Rin) of the subtractor 24 by 3 dB (by multiplying the output signal by 0.707), i.e., the signal S1, is input to the specified band enhancement section 31. As in the case of the first embodiment, the specified band enhancement section 31 generates the output signal Cout (the output signal S2) of the center channel from the signal S1. In the case of having detected the center component in the input signals Lin and Rin, the center component extraction section 21 outputs a control signal C3 to instruct the specified band enhancement section 31 to generate the output signal Cout. Furthermore, in the case of being unable to detect the center component, the center component extraction section 21 causes the specified band enhancement section 31 to stop generating the output signal Cout.

Furthermore, a circuit configuration similar to that shown in FIG. 3 is provided at the rear stage, not shown, of the signal processing device 10C according to the third embodiment, whereby multi-channel signals, i.e., five channel signals, can be generated from the output signal S2. Moreover, the opposite-phase determination section 21B of the center component extraction section 21 is configured, for example, so as to output control signals, not shown, to the amplifiers 69 and 79 shown in FIG. 3 and so as to be able to adjust the gain values thereof. In the case that the opposite-phase determination section 21B detects an opposite-phase component and causes the surround generation section 111 to generate surround channel signals, the gain values of the amplifiers 69 and 79 are set to 0.0 (attenuation amount:

−∞dB), whereby the surround signals generated by the surround generation sections 61 and 71 are stopped from being output. As a result, in the signal processing device 10C, the circuits for generating the surround channel signals can be selected appropriately according to the presence/absence of the detection of the opposite-phase component, whereby the signal processing device 10C can be used for a music signal including an opposite-phase component that is supposed to be subjected to the related-art matrix signal processing by selecting the processing circuits.

The above-mentioned three conditions according to which an opposite-phase component is detected are taken as examples and can be changed as necessary. For example, in the case that at least one of the above-mentioned three conditions is satisfied, the opposite-phase determination section 21B may determine that an opposite-phase component is present. What's more, as in the case of the center component extraction processing of the center component extraction section 21, the detection accuracy of the opposite-phase component may be adjusted by changing a coefficient, for example, by changing (Lin−Rin) in the first and second conditions to (Lin−Rin)*0.5. Still further, the signal processing device 10C may be equipped with a filter circuit, similar to the low-pass filter 43 in the signal processing device 10, for preventing the levels of the surround signals from changing steeply at the detection time or non-detection time of the opposite-phase component. For example, surround signals that are generated by using the opposite-phase component are frequently used as sound effects. Hence, in the case that the opposite-phase component is detected, it is conceivable that the time constant of the filter is changed (for example, 50 ms/6 dB) so that the response is quickened and so that the gain value is changed relatively steeply.

Furthermore, the output of the output signals SLout, SRout, SBLout and SBRout may be selected according to whether the surround signals are stereo signals or monaural signals. For example, it may be possible that, after the following three additional conditions (fourth to sixth conditions) are further added, the opposite-phase determination section 21B makes a determination and selects the output of an output signal SLout for example.

| | |
|---|---|
| Lin>Rin | Fourth condition |
| Lin<Rin | Fifth condition |
| Lin=Rin | Sixth condition |

Lin and Rin in the above-mentioned determination conditions are all absolute values.

The fourth condition corresponds to a case in which the surround component is detected and the sound volume of the input signal Lin of the L channel is larger than that of the input signal Rin of the R channel, that is, a case in which the surround signal is a stereo signal. In this case, it is preferable that the surround signal should be output as the output signal SLout of the surround left channel. The opposite-phase determination section 21B adjusts the gain values of the amplifiers 113 by using a control signal C5 and performs control so that only the output signal SLout is output from the amplifiers 113. Furthermore, the fifth condition corresponds to a case in which the surround component is detected and the sound volume of the input signal Rin is larger than that of the input signal Lin (a case in which the surround signal is a stereo signal). In this case, it is preferable that the surround signal should be output as the output signal SRout of the surround right channel. Moreover, the sixth condition corresponds to a case in which the surround component is detected and the sound volumes of the input signals Lin and Rin are the same or almost the same, that is, the surround signal is a monaural signal. In this case, it is preferable that the surround signal should be evenly distributed to both the L and R surround channels and output as the output signals SLout and SRout or that the surround signal should be output as the output signals SBLout and SBRout of the surround back channels. In the determination of the sixth condition (Lin=Rin), the opposite-phase determination section 21B may determine that the sixth condition is satisfied not only in the case that the amplitude values are completely the same but also in the case that the amplitude values are within a predetermined range (for example, the difference between the signal levels of the input signals Lin and Rin is not more than 3 dB). What's more, it may be possible that a signal processing device is configured so that the processing circuits of the signal processing device 10A according to the second embodiment are combined with the processing circuits of the signal processing device 10C according to the third embodiment.

However, the present invention is not limited to the above-mentioned respective embodiments, but can be improved and modified variously within the scope not departing from the gist of the present invention as a matter of course.

Figure 11:
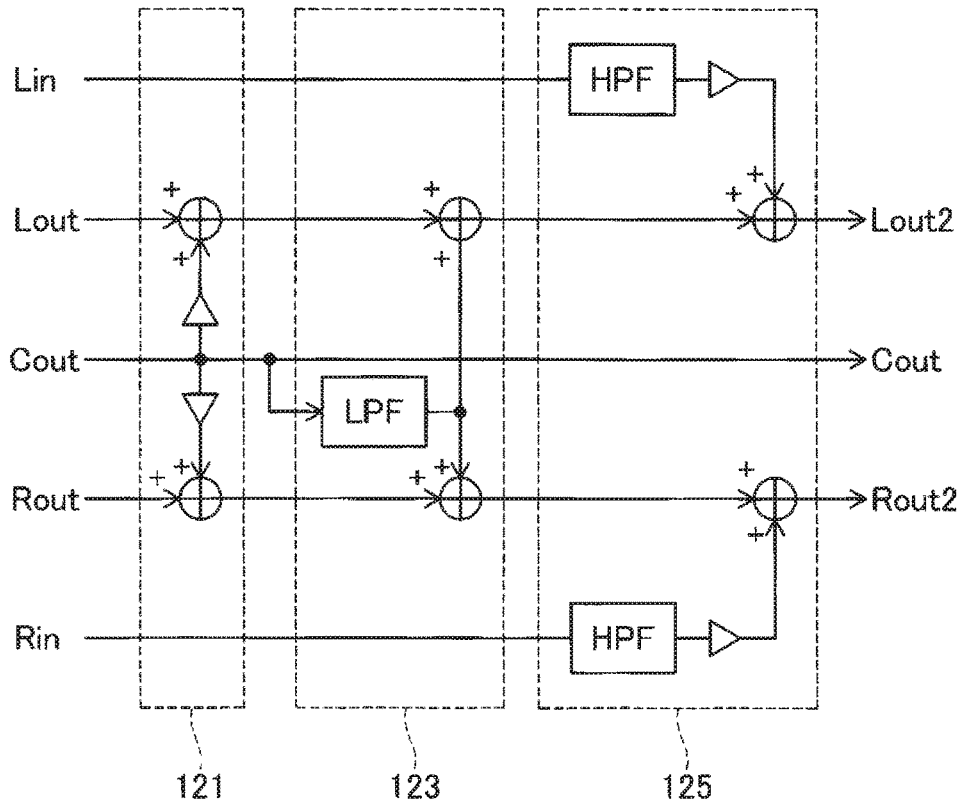
FIG. 11 is a block diagram of a circuit according to another example additionally connected to the signal processing device to impart sound effects.

For example, in the first embodiment described above, the signal processing device 10 may perform additional acoustic processing for the generated output signals Lout and Rout. The circuit shown in FIG. 11 is a circuit block that is additionally connected to the signal processing device 10 according to the first embodiment and is connected to, for example, the rear stage of the circuit block shown in FIG. 3. For example, in the case that an in-phase component is abundantly included in the input signals Lin and Rin and that almost only the center speaker generates sound, the stereo feeling in the reproduced sound is degraded. Hence, the first additional circuit 121 shown in FIG. 11 adjusts the level of the center channel output signal Cout generated in the specified band enhancement section (see FIG. 2) and then adds the output signal Cout to the respective L and R channel output signals Lout and Rout. Consequently, the extracted center signal is returned (added) to newly generated second output signals Lout2 and Rout2, whereby the sound of the center channel can be relieved from being emphasized excessively.

Furthermore, for example, in the case of a multi-channel speaker system, the center speaker is different from the main speakers in performance, and the main speakers are higher in reproduction capability and wider in reproduction frequency band than the center speaker in some cases. Hence, a second additional circuit 123 extracts the low-frequency component included in the output signal Cout of the center channel using a low-pass filter and adds the component to the respective output signals Lout and Rout of the L and R channels. As a result, the newly generated second output signals Lout2 and Rout2 include the low-frequency component of the center channel. Besides, the second output signals Lout2 and Rout2 are reproduced by the main speakers having higher reproduction capability, whereby richer low frequency reproduction can be attained.

Furthermore, for example, in the case that a high-frequency component, the direction of which can be easily perceived, is included in the input signals Lin and Rin as an in-phase component, the component is abundantly extracted as the output signal Cout of the center channel, whereby there is a risk that the spreading feeling of the reproduced sound may be degraded. Hence, a third additional circuit 125 extracts the high-frequency component of the original input signals Lin and Rin using a high-pass filter and adds the component to the output signals Lout and Rout of the L and R channels. As a result, in the newly generated second output signals Lout2 and Rout2, the spreading feeling of the reproduced sound can be maintained.

Like the first to third additional circuits 121, 123 and 125 in which the above-mentioned output signal Cout of the center channel is used, circuits may be configured to process the signals generated for surround back channels. For example, like the first additional circuit 121, a circuit for adding the output signal SLout of the surround left channel to the output signal Lout and for adding the output signal SRout of the surround right channel to the output signal Rout may be connected to the rear stage. With this configuration, the surround back signals can be relieved from being emphasized excessively as in the case of the output signal Cout of the center channel.

Moreover, although the center channel signal is generated from the L and R channel signals on the front side or the surround back signals are generated from the surround right and left signals on the surround side in the above-mentioned respective embodiments, the methods for signal generation are not limited to these. For example, the L channel signal on the front side and the surround left channel signal may be used to generate a wide channel signal that is localized at the position between the speakers outputting the two signals.

The signal processing devices according to the above-mentioned respective embodiments can be accomplished by not only hardware (electronic circuits) such as a DSP (digital signal processor) dedicated for processing music signals but also the cooperation of a general-purpose arithmetic processing device such as a CPU (central processing unit) and programs. Programs relating to the preferred embodiments of the present invention can be provided in a form stored in a computer-readable recording medium and can be installed in a computer. The recording medium is, for example, a non-transitory recording medium, and an optical recording medium (optical disc), such as a CD-ROM, is taken as a good example. However, the recording medium can include recording media conforming to known arbitrary forms, such as semiconductor recording media and magnetic recording media. Furthermore, the programs of the present invention can be provided so as to be distributed via a communication network and can be installed in a computer.

Moreover, the present invention can also be specified as methods (signal processing methods) for operating the signal processing devices according to the respective embodiments exemplified above.

According to the present invention, there is provided a signal processing device comprising: a calculating unit which is configured to perform calculation using a signal level of a first acoustic signal and a signal level of a second acoustic signal; a determining unit, based on a result of a comparison between: the signal level of at least one of the first acoustic signal and the second acoustic signal before the calculation; and a result of the calculation, which is configured to determine whether a component of a third acoustic signal to be output from a position between a position from which the first acoustic signal is output and a position from which the second acoustic signal is output is included in the first acoustic signal and the second acoustic signal; and a signal generating unit which is configured to generate the third acoustic signal from the first acoustic signal and the second acoustic signal when the determining unit is configured to determine that the component of the third acoustic signal is included in the first acoustic signal and the second acoustic signal.

The determining unit of the signal processing device compares the signal level of each of the first acoustic signal and the second acoustic signal of two channels with the value obtained by calculating the levels of these two signals, thereby determining whether the component of a third acoustic signal is included. In the case that the determining unit determines that the component of the third acoustic signal is included, the signal generating unit generates the third acoustic signal from the first and second acoustic signals. Hence, in the signal processing device, while a determination is made as to whether the component of the third acoustic signal is present by comparing the levels of the two signals before the calculation with the calculation results of the levels of the two signals, the third acoustic signal is generated as necessary, whereby the number of channels can be extended. Hence, in acoustic signals, such as general music signals, that are not supposed to be subjected to the matrix signal processing or the like, a determination is made as to whether the component of the third acoustic signal is present in the first acoustic signal and the second acoustic signal of the two channels, and channel extension can be carried out according to the result of the determination. The acoustic signals in the present application are not limited to music signals but include, for example, acoustic signals for movies that are used together with streaming video.

The first acoustic signal and the second acoustic signal may be acoustic signals of channels on a front side, the calculating unit may be configured to subtract, from the signal level of one of the first acoustic signal and the second acoustic signal, the signal level of the other of the first acoustic signal and the second acoustic signal, and the determining unit may include an opposite-phase determining unit which is configured to determine whether an opposite-phase component is included in the first acoustic signal and the second acoustic signal based on the result of the calculation of the calculating unit. The signal processing device may further comprise: a surround generating unit which is configured to output a signal obtained by subtracting the second acoustic signal from the first acoustic signal as a surround channel signal when the determining unit is configured to determine that the opposite-phase component is included in the first acoustic signal and the second acoustic signal.

In the signal processing device, the opposite-phase determining unit of the determining unit can determine whether the opposite-phase component (for example, a surround component) being used in conventional movie contents or the like and supposed to be subjected to the matrix signal processing is included in the first acoustic signal and the second acoustic signal in the determination using the result of the signal level subtraction by the calculating unit. Furthermore, the surround generating unit generates a surround channel signal according to the determination result of the opposite-phase determining unit. Consequently, the channel extension processing can also be carried out for the acoustic signals including the opposite-phase component being supposed to be subjected to the conventional matrix signal processing.

In case where the signal level of the first acoustic signal is A1 and the signal level of the second acoustic signal is A2, the determining unit may be configured to determine that the component of the third acoustic signal is included in the first acoustic signal and the second acoustic signal when at least one of four conditions represented by (A1+A2)>A1, (A1+A2) >A2, (A1−A2)<A1 and (A1−A2)<A2 is satisfied.

In the case that at least one of the four conditions is satisfied, the determining unit determines that the component of the third acoustic signal is included in the first acoustic signal and the second acoustic signal as an in-phase component. Consequently, channel extension can be performed according to whether the component of the third acoustic signal serving as the in-phase component is present.

In case where the signal level of the first acoustic signal is A1 and the signal level of the second acoustic signal is A2, the opposite-phase determining unit may be configured to determine that the opposite phase component is included in the first acoustic signal and the second acoustic signal when at least one of three conditions represented by (A1−A2)>A1, (A1−A2)>A2, (A1−A2)>(A1+A2) is satisfied.

In the case that at least one of the three conditions is satisfied, the determining unit determines that the opposite-phase component (for example, a surround component) being supposed to be subjected to the matrix signal processing is included in the first acoustic signal and the second acoustic signal. Consequently, channel extension can be carried out by generating a surround channel signal according to whether the opposite-phase component is present.

The opposite-phase determining unit may be configured to compare the signal level of the first acoustic signal with the signal level of the second acoustic signal, determine whether the surround channel signal is a stereo signal or a monaural signal, and select whether from which of a plurality of surround channels the surround channel signal is output according to a result of the determination.

The opposite-phase determining unit determines whether the surround channel signal is a stereo signal or a monaural signal by comparing the signal levels of the first acoustic signal and the second acoustic signal. According to the result of the determination, the generated surround channel signal can be distributed appropriately to, for example, the surround left, surround right and surround back channels.

The determining unit may be configured to determine that the component of the third acoustic signal is included in the first acoustic signal and the second acoustic signal when the signal levels of the first acoustic signal and the second acoustic signal are not more than a predetermined value.

For example, in the case of the L and R two-channel acoustic signals, voice in a vocal is not included in the introduction and interlude thereof and the signal level becomes small, whereby there is a risk that the determination as to whether the acoustic signal component of the center channel is included in the L and R acoustic signals may not be made accurately. The L and R channel acoustic signals are herein used as examples of the first acoustic signal and the second acoustic signal. Furthermore, the acoustic signal component of the center channel is used as an example of the component of the third acoustic signal. In the case that the signal levels of the first acoustic signal and the second acoustic signal are not more than a predetermined value, the determining unit makes a determination assuming that the component of the third acoustic signal is included, whereby the third acoustic signal can also be extracted even in the case of the above-mentioned introduction and the like.

The signal processing device may further comprise: a band dividing unit which is configured to divide the third acoustic signal extracted by the signal generating unit into respective frequency bands; a maximum level detecting unit which is configured to detect the frequency band having the highest signal level in the respective frequency bands divided by the band dividing unit; and an extracting unit which is configured to output a signal corresponding to the frequency band detected by the maximum level detecting unit as the third acoustic signal.

The band dividing unit divides the third acoustic signal extracted by the signal generating unit into a plurality of bands. The maximum level detecting unit detects the band having the highest signal level from the plurality of bands. The extracting unit extracts the signal in the band having the highest signal level as a third acoustic signal. Consequently, the band having the maximum signal level that changes at every reproduction time is detected, and the sound in the band is output as the third acoustic signal, whereby the sound in the appropriate band can be emphasized.

The determining unit may include a monaural signal determining unit which is configured to determine whether the first acoustic signal and the second acoustic signal are monaural signals, and the monaural signal determining unit may be configured to control the extracting unit to output all the frequency bands of the third acoustic signal when the first acoustic signal and the second acoustic signal are the monaural signals.

In the case that the first acoustic signal and the second acoustic signal are monaural signals, the monaural signal determining unit causes the extracting unit to output all frequency band signals as the third acoustic signal.

Consequently, a sound in a specific frequency band is prevented from being emphasized although the acoustic signal is a monaural signal.

Furthermore, the invention according to the present application is not limited to a signal processing device but can be embodied as a signal generating method for extending two acoustic signals to multi-channel signals.

With the signal processing device according to the present application, multi-channel acoustic signals can be generated from two-channel acoustic signals.

What is claimed is:

1. A signal processing device comprising:

a calculating unit which is configured to perform calculation using a signal level of a first acoustic signal and a signal level of a second acoustic signal;

a determining unit configured to determine whether a component of a third acoustic signal to be output from a position between a position from which the first acoustic signal is output and a position from which the second acoustic signal is output is included in the first acoustic signal and the second acoustic signal, wherein the determination is based on a result of a comparison between (i) the signal level of one or more of: the first acoustic signal and the second acoustic signal and (ii) a result of the calculation by the calculating unit, the first and second acoustic signals being original input signals and the result of the calculation being an output signal; and a signal generating unit which is configured to generate the third acoustic signal from the first acoustic signal and the second acoustic signal when the determining unit is configured to determine that the component of the third acoustic signal is included in the first acoustic signal and the second acoustic signal.

2. The signal processing device according to claim 1, wherein the first acoustic signal and the second acoustic signal are acoustic signals of channels on a front side, the calculating unit is configured to subtract, from the signal level of one of the first acoustic signal and the second acoustic signal, the signal level of the other of the first acoustic signal and the second acoustic signal, and the determining unit includes an opposite-phase determining unit which is configured to determine whether an opposite-phase component is included in the first acoustic signal and the second acoustic signal based on the result of the calculation of the calculating unit, the signal processing device further comprising:

a surround generating unit which is configured to output a signal obtained by subtracting the second acoustic signal from the first acoustic signal as a surround channel signal when the determining unit is configured to determine that the opposite-phase component is included in the first acoustic signal and the second acoustic signal.

3. The signal processing device according to claim 1, wherein, in case where the signal level of the first acoustic signal is A1 and the signal level of the second acoustic signal is A2, the determining unit is configured to determine that the component of the third acoustic signal is included in the first acoustic signal and the second acoustic signal when at least one of four conditions represented by $(A1+A2)>A1$, $(A1+A2)>A2$, $(A1-A2)<A1$ and $(A1-A2)<A2$ is satisfied.

4. The signal processing device according to claim 2, wherein the opposite-phase determining unit is configured to compare the signal level of the first acoustic signal with the signal level of the second acoustic signal, determine whether the surround channel signal is a stereo signal or a monaural signal, and select whether from which of a plurality of surround channels the surround channel signal is output according to a result of the determination.

5. The signal processing device according to claim 2, wherein, in case where the signal level of the first acoustic signal is A1 and the signal level of the second acoustic signal is A2, the opposite-phase determining unit is configured to determine that the opposite phase component is included in the first acoustic signal and the second acoustic signal when at least one of three conditions represented by $(A1-A2)>A1$, $(A1-A2)>A2$, $(A1-A2)>(A1+A2)$ is satisfied.

6. The signal processing device according to claim 5, wherein the opposite-phase determining unit is configured to compare the signal level of the first acoustic signal with the signal level of the second acoustic signal, determine whether the surround channel signal is a stereo signal or a monaural signal, and select whether from which of a plurality of surround channels the surround channel signal is output according to a result of the determination.

7. The signal processing device according to claim 1, wherein the determining unit is configured to determine that the component of the third acoustic signal is included in the first acoustic signal and the second acoustic signal when the signal levels of the first acoustic signal and the second acoustic signal are not more than a predetermined value.

8. The signal processing device according to claim 1, further comprising:

a band dividing unit which is configured to divide the third acoustic signal extracted by the signal generating unit into respective frequency bands;

a maximum level detecting unit which is configured to detect the frequency band having the highest signal level in the respective frequency bands divided by the band dividing unit; and an extracting unit which is configured to output a signal corresponding to the frequency band detected by the maximum level detecting unit as the third acoustic signal.

9. The signal processing device according to claim 8, wherein, the determining unit includes a monaural signal determining unit which is configured to determine whether the first acoustic signal and the second acoustic signal are monaural signals, and the monaural signal determining unit is configured to control the extracting unit to output all the frequency bands of the third acoustic signal when the first acoustic signal and the second acoustic signal are the monaural signals.

10. A signal processing method comprising:

performing calculation using a signal level of a first acoustic signal and a signal level of a second acoustic signal;

determining whether a component of a third acoustic signal to be output from a position between a position from which the first acoustic signal is output and a position from which the second acoustic signal is output is included in the first acoustic signal and the second acoustic signal, wherein the determining is based on a result of a comparison between (i) the signal level of one or more of: the first acoustic signal and the second acoustic signal and (ii) a result of the calculation, the first and second acoustic signals being original input signals and the result of the calculation being an output signal; and generating the third acoustic signal from the first acoustic signal and the second acoustic signal when the component of the third acoustic signal is included in the first acoustic signal and the second acoustic signal.

11. A non-transitory computer-readable storage medium storing a computer program that causes a signal processing device to execute a signal processing method comprising:

performing calculation using a signal level of a first acoustic signal and a signal level of a second acoustic signal;

determining whether a component of a third acoustic signal to be output from a position between a position from which the first acoustic signal is output and a position from which the second acoustic signal is output is included in the first acoustic signal and the second acoustic signal, wherein the determining is based on a result of a comparison between (i) the signal level of one or more of: the first acoustic signal and the second acoustic signal and (ii) a result of the calculation, the first and second acoustic signals being original input signals and the result of the calculation being an output signal; and generating the third acoustic signal from the first acoustic signal and the second acoustic signal when the component of the third acoustic signal is included in the first acoustic signal and the second acoustic signal.

12. The signal processing method according to claim 10, wherein the first acoustic signal and the second acoustic signal are acoustic signals of channels on a front side, the performing of the calculation includes subtracting, from the signal level of one of the first acoustic signal and the second acoustic signal, the signal level of the other of the first acoustic signal and the second acoustic signal, and the determining includes an opposite-phase determining for determining whether an opposite-phase component is included in the first acoustic signal and the second acoustic signal based on the result of the calculation, and the signal processing method further comprising:

outputting a signal obtained by subtracting the second acoustic signal from the first acoustic signal as a surround channel signal when determining that the opposite-phase component is included in the first acoustic signal and the second acoustic signal.

13. The signal processing method according to claim 10, wherein, in case where the signal level of the first acoustic signal is A1 and the signal level of the second acoustic signal is A2, determining that the component of the third acoustic signal is included in the first acoustic signal and the second acoustic signal when at least one of four conditions represented by $(A1+A2)>A1$, $(A1+A2)>A2$, $(A1-A2)<A1$ and $(A1-A2)<A2$ is satisfied.

14. The signal processing method according to claim 12, wherein the opposite-phase determining includes comparing the signal level of the first acoustic signal with the signal level of the second acoustic signal, determining whether the surround channel signal is a stereo signal or a monaural signal, and selecting whether from which of a plurality of surround channels the surround channel signal is output according to a result of the determination.

15. The signal processing method according to claim 12, wherein, in case where the signal level of the first acoustic signal is Al and the signal level of the second acoustic signal is A2, the opposite-phase determining includes determining that the opposite phase component is included in the first acoustic signal and the second acoustic signal when at least one of three conditions represented by $(A1-A2)>A1$, $(A1-A2)>A2$, $(A1-A2)>(A1+A2)$ is satisfied.

16. The signal processing method according to claim 15, wherein the opposite-phase determining includes comparing the signal level of the first acoustic signal with the signal level of the second acoustic signal, determining whether the surround channel signal is a stereo signal or a monaural signal, and selecting whether from which of a plurality of surround channels the surround channel signal is output according to a result of the determination.

17. The signal processing method according to claim 10, wherein the determining includes determining that the component of the third acoustic signal is included in the first acoustic signal and the second acoustic signal when the signal levels of the first acoustic signal and the second acoustic signal are not more than a predetermined value.

18. The signal processing method according to claim 10, further comprising:

dividing the third acoustic signal into respective frequency bands;

detecting the frequency band having the highest signal level in the respective divided frequency bands; and outputting a signal corresponding to the frequency band as the third acoustic signal.

19. The signal processing method according to claim 18, wherein, the determining includes a monaural signal determining for determining whether the first acoustic signal and the second acoustic signal are monaural signals, and the monaural signal determining includes controlling the extracting to output all the frequency bands of the third acoustic signal when the first acoustic signal and the second acoustic signal are the monaural signals.

* * * * *